US007356944B2

(12) United States Patent
Moschuetz et al.

(10) Patent No.: US 7,356,944 B2
(45) **Date of Patent: *Apr. 15, 2008**

(54) DRYING RACK FOR A LAUNDRY DRYER

(75) Inventors: Harald Moschuetz, Grossbeeren (DE); Hans-Werner Stahn, Berlin (DE); Guenter Steffens, Seeburg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/317,046

(22) Filed: Dec. 23, 2005

(65) Prior Publication Data

US 2006/0096120 A1 May 11, 2006

Related U.S. Application Data

(63) Continuation of application No. 10/629,925, filed on Jul. 30, 2003, now Pat. No. 7,007,409, which is a continuation of application No. PCT/EP02/00802, filed on Jan. 25, 2002.

(30) Foreign Application Priority Data

Jan. 30, 2001 (DE) ..... 101 03 987

(51) Int. Cl.
*F26B 5/06* (2006.01)

(52) U.S. Cl. ..... 34/286

(58) Field of Classification Search ..... 34/602, 34/603, 601, 286, 600
See application file for complete search history.

(56) References Cited

U.S. PATENT DOCUMENTS

| | | | | |
|---|---|---|---|---|
| 2,867,106 | A * | 1/1959 | Stone, Jr. et al. | 68/24 |
| 3,316,659 | A * | 5/1967 | Lauck | 34/600 |
| 4,091,548 | A * | 5/1978 | Daily | 34/600 |
| 4,908,959 | A * | 3/1990 | Kretchman et al. | 34/609 |
| 5,519,949 | A * | 5/1996 | Gibson, Jr. | 34/600 |
| 6,604,298 | B2 * | 8/2003 | Tomasi et al. | 34/600 |
| 6,915,593 | B2 * | 7/2005 | Gruble et al. | 34/600 |
| 7,007,409 | B2 * | 3/2006 | Moschutz et al. | 34/602 |

* cited by examiner

*Primary Examiner*—S. Gravini
(74) *Attorney, Agent, or Firm*—Russell W. Warnock; James E. Howard

(57) ABSTRACT

A drying rack for the stationary drying of articles to be dried, which can be installed in the drum of a clothes dryer. The articles can be knitwear or shoes that must not be moved when dried even when the drum turns. For articles, especially, wool articles, to dry faster, the drying rack has at least two spaced-apart surfaces disposed one on top of the other on which the articles to be dried can be spread, thereby substantially enlarging the surface of the articles to be dried. As such, the drying air current can better remove the moisture and larger individual wool articles can be dried in the clothes dryer.

15 Claims, 2 Drawing Sheets

DRYING RACK FOR A LAUNDRY DRYER

CROSS-REFERENCE TO RELATED APPLICATION

This application is a continuation of U.S. patent application Ser. No. 10/629,925, filed on Jul. 30, 2003, now U.S. Pat. No. 7,007,409, which was a continuation of International Application No. PCT/EP02/00802, filed Jan. 25, 2002, which designated the United States and was not published in English.

FIELD OF THE INVENTION

The invention relates to a drying rack for the stationary configuration of a batch to be dried within a rotatable drum of a laundry dryer, with a filling orifice issuing into the drum and with a door for closing the filling orifice and to a laundry dryer with the rack.

BACKGROUND OF THE INVENTION

The stationary configuration of a batch may be necessary when the batch is not to be moved during the drying operation. This may be the case, for example, with regard to knitted fabrics and articles of clothing made of wool that would shrink if they were moved during drying. The same may apply to shoes or other batches that could be damaged as a result of movement in the drum.

Such a drying rack or a dryer is known, for example, from German Published, Non-Prosecuted Patent Application DE 40 34 660 A1. This describes a drying rack in the form of a laundry basket that is fastened at the rear to the mounting of the drum rear wall and, at the front, to the dryer door. The laundry basket is in the form of an upwardly open tray or shell and is manufactured from wire netting or grille. Comparable drying racks are known from German Published, Non-Prosecuted Patent Application DE 27 06 595, German Utility Model DE 85 05 995 U1, and U.S. Pat. No. 3,344,532 to Bigler, U.S. Pat. No. 3,316,659 to Lauck, and U.S. Pat. No. 4,591,548. All the above-mentioned publications likewise describe drying racks in the form of an upwardly open tray. Although drying racks so configured can receive a large volume, they, nevertheless, have, in particular, the disadvantage that the batch in them forms a ball. As a result, the drying-air stream reaches the core of the ball inadequately and the ball is, therefore, dried only slowly or not at all. This is the case particularly with regard to batches of wool because, in contrast to cotton, wool does not possess a wick effect and cannot conduct the moisture from the inside outward onto the surface to the drying-air stream. For this reason, it is not possible, with the known drying racks, to dry relatively large articles of clothing made of wool, such as, for example, pullovers.

BRIEF SUMMARY OF THE INVENTION

It is accordingly an object of the invention to provide a drying rack for a laundry dryer that overcomes the hereinafore-mentioned disadvantages of the heretofore-known devices of this general type and by which batches, particularly of wool, which are disposed in a stationary manner can be dried more quickly and more efficiently.

With the foregoing and other objects in view, in a laundry dryer having a rotatable drum with a filling orifice issuing into the drum and a door for closing the filling orifice, there is provided, in accordance with the invention, a drying rack including at least two air-permeable surfaces holding in a stationary manner within the drum a batch of laundry to be dried being disposed at a distance one above another in an operating state thereof and having a front side defining an access orifice and a side defining at least one further access orifice, and fastening devices removably fastening the surfaces to the laundry dryer.

By providing a plurality of surfaces or levels, on which the batches can be disposed or spread out, the batch surface that can be reached by the drying-air stream can be enlarged. As such, larger articles of clothing do not have to be dried as a ball, but can be spread out in a flatter way and, in particular, in a single layer. Consequently, it also becomes possible to dry, in a dryer, larger articles of clothing made of wool, for example, pullovers, dresses, or skirts, which could, otherwise, not be dried as a ball because the ball would remain wet in the core and would be over-dried at the surface. Over-drying at the surface would damage the fabric and constitutes a high safety risk because over-dried and overheated fabric can easily be ignited.

In addition, the drying operation becomes more efficient because the hot drying air is utilized more effectively and can absorb more moisture on account of the enlarged surface of the batch. Where woolen articles of clothing are concerned, by being spread out in a single layer on a plurality of surfaces, the drying of these is not only accelerated, but is made possible for the first time.

The regions formed by the edges of surfaces disposed one above the other are, preferably, for the most part open. Thus, larger batches can be distributed over a plurality of surfaces, in that a portion is disposed on one surface and the portion projecting beyond the surface edge is folded around the edge and is disposed on an adjacent surface. For example, a pullover can, advantageously, be disposed on a drying rack having three surfaces, with the chest region in the upper surface, while the sleeves can be folded round at the sides and be disposed on the middle surface lying underneath it, and the pullover body region adjoining the chest region below the latter is introduced into the lowermost surface in the same way.

In accordance with another feature of the invention, the surfaces are releasably connected to the drying rack, in particular, to the fastening devices.

By a releasable connection of the surfaces to the drying rack, the batch can be disposed on the surfaces in a simpler way because, to load one surface, a surface lying above it can be removed. This may also be achieved by an articulated connection of the surfaces, in which case, in addition, the individual surfaces cannot be lost.

In accordance with a further feature of the invention, the at least one of the surfaces is connected in an articulated manner to another of the surfaces.

In accordance with an added feature of the invention, the at least one of the surfaces is pivotably connected to another of the surfaces.

In accordance with an additional feature of the invention, the articulated surface has supports, at least one of the surfaces has first receptacles for receiving a device, and at least one removable air-permeable surface is received in the first receptacles and has second receptacles for receiving the supports.

In accordance with yet another feature of the invention, there are provided intermediate members respectively connecting at least one of the surfaces in an articulated manner to the articulated surface.

One surface is connected to the drying rack through the articulated intermediate piece, this surface having supports that are disposed at a distance from the point of articulation of the intermediate piece and can co-operate with receptacles that are formed either in the drying rack itself or in a further surface that is connectable to the drying rack. By the articulated intermediate piece, it is possible for the surface connected through the intermediate piece to be disposed in various ways because, with the supports being used, the surface and the intermediate piece can be inclined, on one hand, upwardly and, on the other hand, downwardly. The surface articulated through the intermediate piece can, consequently, be disposed at various heights, a plurality of different configurations of the surface also being possible in the case of a plurality of receptacles for the supports. For the drying of larger articles, for example, with the intermediate piece being inclined downwardly, the surface can be disposed at the bottom so that sufficient space for the batch remains above the surface.

In accordance with yet a further feature of the invention, there are provided connecting members, the surfaces having corners, the connecting members holding the surfaces at a distance from one another at the corners.

In accordance with yet an added feature of the invention, the surfaces have a given thickness and the connecting members have a thickness greater than or equal to the given thickness and less than three times the given thickness.

It is also conceivable for all the surfaces to be configured so as to be releasable from the drying rack, in which case the surfaces may also remain connected to one another so that, as a block, they can be released from the drying rack, loaded, and reinserted.

The drying rack and the surfaces may be manufactured from netting, in particular, of metal wire, so that high mechanical stability, along with high air permeability, can be achieved.

In accordance with yet an additional feature of the invention, the surfaces have an air-permeable fine-mesh and flexible plastic nettings each with a surrounding plastic frame.

In accordance with again another feature of the invention, there is provided an air-permeable self-supporting outer casing forming a closed netting shape along a circumferential surface of the laundry drum, the outer casing being connected to the surfaces.

If the drying rack is provided with an outer casing, in order to prevent batches from falling out over the edge of a surface and/or to prevent contact between batches and the rotating drum, the drying rack may be manufactured, for example, from a netting structure that has a smaller mesh width in the lower region than in the upper region or in which a lower netting part is spanned on top by bars. Consequently, small batches can be prevented from falling through, and safety can, nevertheless, be increased.

Advantageously, the outer casing is closed on all sides, with the exception of an access orifice that is disposed behind the filling orifice of the laundry dryer and, in particular, can be closed by the door of the latter. The drying rack may, for example, be in the form of a cylinder that is open on one end face and that can be inserted horizontally into the laundry dryer.

Particularly with regard to a drying rack having an outer casing, it is appropriate to combine the surfaces as a separate inner rack that is connected releasably to the outer casing that forms an outer rack. In such a case, there may be provision for the fastening devices for fastening to the laundry dryer to be disposed on the outer casing. The inner rack may either be introduced without further fastening or be fastened to the outer rack by simple compact fastenings so that the extracted inner rack is simple to handle.

The drying rack may, furthermore, be configured such that the inner rack is maintained at a distance from the bottom of the outer casing so that, in addition to the surfaces of the inner rack, the bottom of the outer casing may be utilized for depositing batches.

To fasten the drying rack to the laundry dryer, three fastening devices are, advantageously, provided, in order to prevent mechanical redundancy, in which case, the three fastening devices may be provided, for example, centrally at the bottom and on the left and right of the filling orifice of the laundry dryer.

In accordance with again a further feature of the invention, the outer casing has a rear side and a netting-shaped closure at the rear side. Preferably, the outer casing is of a wire netting.

In accordance with again an added feature of the invention, the outer casing has at least two parts connected to one another in an articulated manner.

In accordance with again an additional feature of the invention, the outer casing has at least two parts pivotably connected to one another.

With the objects of the invention in view, there is also provided a laundry dryer, including a rotatable drum with a filling orifice issuing into the drum, the drum having a front bearing plate with a loading orifice and plate fastening devices, a door connected to the bearing plate for closing at least one of the filling orifice and the loading orifice, and a drying rack having at least two air-permeable surfaces holding in a stationary manner within the drum a batch of laundry to be dried being disposed at a distance one above another in an operating state thereof and having a front side defining an access orifice and a side defining at least one further access orifice, and rack fastening devices removably fastening the surfaces to the plate fastening devices and matching the plate fastening devices.

With the objects of the invention in view, there is also provided a laundry dryer, including a housing, a rotatable drum with a filling orifice issuing into the drum, the drum being rotatably connected to the housing and having a front bearing plate with a loading orifice and plate fastening devices, a door connected to the housing for closing at least one of the filling orifice and the loading orifice, and a drying rack having at least two air-permeable surfaces holding in a stationary manner within the drum a batch of laundry to be dried being disposed at a distance one above another in an operating state thereof and having a front side defining an access orifice and a side defining at least one further access orifice, and rack fastening devices removably fastening the surfaces to the plate fastening devices and corresponding with the plate fastening devices.

With the objects of the invention in view, there is also provided a laundry dryer drying rack, including at least two air-permeable surfaces for holding in a stationary manner a batch of laundry to be dried within a rotatable drum of a laundry dryer, the surfaces being disposed at a distance one above another in an operating state thereof and having a front side defining an access orifice and a side defining at least one further access orifice, and fastening devices for removably fastening the surfaces to the laundry dryer.

With the objects of the invention in view, there is also provided a laundry dryer drying rack, including at least two air-permeable surfaces for holding in a stationary manner a batch of laundry to be dried within a rotatable drum of a laundry dryer, the surfaces being disposed at a distance one above another in an operating state thereof and having a front side defining an access orifice and a side defining at least one further access orifice, at least one of the surfaces being connected in an articulated manner to another of the surfaces, fastening devices for removably fastening the surfaces to the laundry dryer, and an air-permeable self-supporting outer casing forming a closed netting shape along a circumferential surface corresponding to the laundry drum, the outer casing being connected to the surfaces.

Other features that are considered as characteristic for the invention are set forth in the appended claims.

Although the invention is illustrated and described herein as embodied in a drying rack for a laundry dryer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

Particular details and further advantages are explained in more detail by reference to the following drawings, which are to illustrate the invention not restrictively, but merely by way of example, wherein there is shown schematically in.

Figure 1:
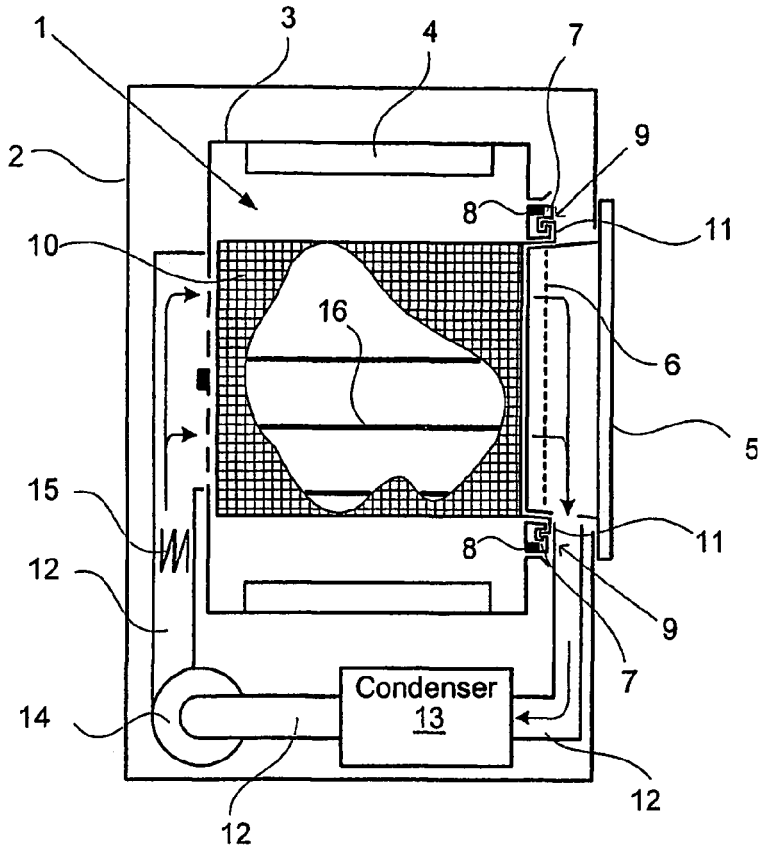
FIG. 1 is a cross-sectional view of a laundry dryer with an inserted drying rack according to a first embodiment of the invention.

Before the embodiments of the invention are explained in detail, it is to be understood that the invention is not limited in its application to the details of construction and the arrangements of components set forth in the following description of illustrated in the drawings. The invention is capable of other embodiments and of being practiced or of being carried out in various ways. Also, it is to be understood that the phraseology and terminology used herein is for the purpose of description and should not be regarded as limiting. In addition, the drawings may not be drawn to scale.

DETAILED DESCRIPTION OF THE INVENTION

Referring now to the figures of the drawings in detail and first, particularly to FIG. 1 thereof, there is shown a laundry dryer 2 having a drum 3 that is rotatable about a horizontal axis and within which laundry drivers 4 are fastened to move the laundry during the drum rotation. Furthermore, a blower 14, a heating device 15, and a condenser 13 are provided to generate air circulation, closed by the air duct 12, through the drum 3. In such a case, air heated by the heating device 15 is conducted from the rear through the perforated bottom of the drum 3 into the drum 3, comes into contact there with the laundry to be dried, and flows through the filling orifice of the drum 3 to a lint filter 6 within a dryer door 5 closing the filling orifice. The air stream in the dryer door 5 is, subsequently, deflected downward and is conducted from the air duct 12 to the condenser 13, in which laundry moisture absorbed by the air condenses as a result of cooling and is discharged. Downstream of the condenser 13, air is conducted, in turn, to the heating device 15 by the blower 14.

The drum 3 is mounted at the rear on the bottom by a rotary bearing and at the front by a bearing plate 7, the drum 3 resting with a rim on a sliding strip 8 on the bearing plate 7 and, thus, being held at the front end.

Furthermore, within the drum 3, a drying rack 1 is disposed. The drying rack 1 includes an outer casing 10 and an inner rack 16 disposed within the outer casing 10. The outer casing 10 is of a cylindrical wire basket that is closed at a bottom. The outer casing 10 of the drying rack 1 has, at its front open end, fastening tabs 11 that can co-operate with corresponding fastening receptacles 9 formed within the bearing plate 7.

By fastening the drying rack 1 solely to the bearing plate 7, the drying rack 1 can be disposed in a stationary manner within the rotatable drum 3 at a particularly low outlay.

Figure 4:
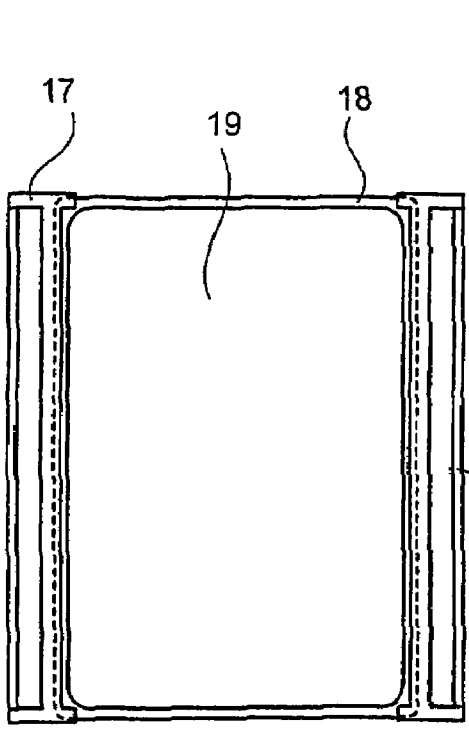
FIG. 4 is an elevational view from above the drying rack of FIG. 1.
Figure 5:
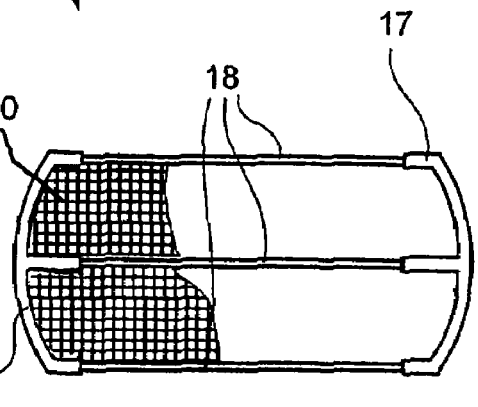
FIG. 5 is an elevational view from the front of the drying rack of FIG. 4.
Figure 6:
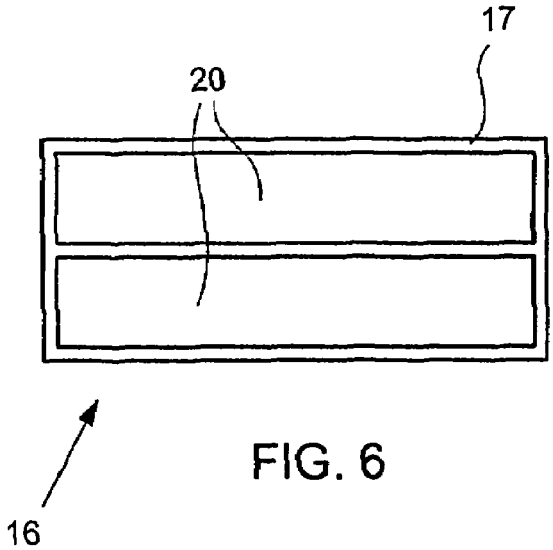
FIG. 6 is an elevational view from the side of the drying rack of FIG. 4.

The inner rack 16, illustrated only partially in FIG. 1, is, additionally, illustrated, according to a first embodiment, in FIGS. 4 to 6. The top view shown in FIG. 4 shows two edge parts 17 that serve to connect the surfaces disposed one above the other. The individual surfaces are formed by plastic frames 18, in which a fine air-permeable plastic net 19 is tensioned. This may be achieved in that, during the production of the frames 18, the plastic net 19 is introduced into the mold of these and is injection-molded into the frame 18.

In the front view illustrated in FIG. 5, the fastening of the plastic frames 18 in the side parts 17 can be seen. For such a purpose, the E-shaped side parts 17 have receptacles, into which the plastic frames 18 can be plugged and, if appropriate, interlocked. From this view a fragmentary portion of the netting-shaped closure 30 is visible at the rear side of the drying rack 1.

By virtue of this refinement, advantageously, only two different parts are necessary, on one hand, the side parts 17 and, on the other hand, the surfaces of the frames 18 and of the plastic net 19.

FIG. 6 illustrates the inner rack 16 from the side, illustrating particularly, within the side parts 17, the lateral access orifices 20 through which it is possible to reach between the surfaces 18, 19 from the side. As such, a batch projecting beyond a surface 18, 19 can be folded around the edge both at the side and at the front and the folded-round part can be disposed on an adjacent surface. For example, the pair of trousers can be introduced into the inner rack in an S-shaped manner. Where a pullover is concerned, for example, the chest region can be folded round onto the upper surface and the lower body region be folded round in the front region and onto the lower surface and the sleeves can be laid onto the middle surface from the side.

It is, nonetheless, possible to use the outer casing 10 without the inner rack 16, in order, for example, to dry shoes in it.

Figure 2:
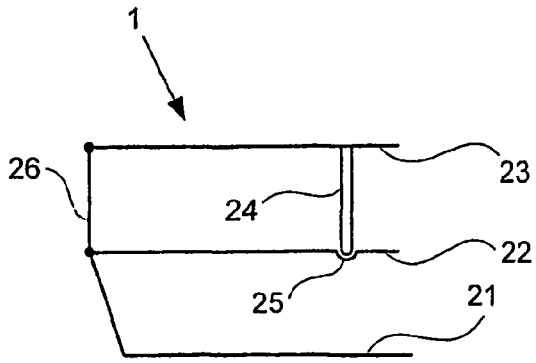
FIG. 2 is a diagrammatic side elevational view of a second embodiment of the drying rack according to the invention.
Figure 3:
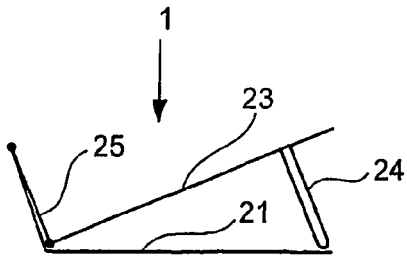
FIG. 3 is diagrammatic side elevational view of the drying rack of FIG. 2 with a different configuration of the surfaces.

A second embodiment of the drying rack 1 is illustrated in FIGS. 2 and 3. In the drying rack 1 illustrated in a sectional side view there, three surfaces 21, 22, 23 are provided, of which the lower surface 21 forms the basic body for the drying rack 1 and has non-illustrated fastening devices for fastening to the laundry dryer 2.

Connected to the surface 21 in an articulated manner is an intermediate piece 26 to which, in turn, the upper surface 23 is connected in an articulated manner. The upper surface 23 has, on its underside at a distance from the intermediate piece 26, supports 24.

The drying rack 1 has receptacles for the middle surface 22 that is releasably connected to the drying rack 1 or is removable and that has receptacles 25 for the supports 24 of the surface 23 disposed above it, the receptacles 25 also giving the supports 24 a hold in the horizontal direction. As such, with the middle surface 22 inserted, the upper surface 23 can be disposed parallel and at a distance from it, the upper surface 23 resting on the supports 24 and on the intermediate piece 26. When the middle surface 22 is removed, the intermediate piece 26 can be pivoted downward and the upper surface 23 can be set down by the supports 24 on the lower surface 21 so that the upper surface 23 is disposed at the bottom and is inclined. In such a configuration, sufficient space above the upper surface 23 remains for the configuration of larger batches, such as, for example, shoes.

The surfaces 21, 22, 23 may have, at the edges, edge regions that are bent upward parallel to the plane of the drawing sheet to prevent batches disposed on them from falling down at the sides.

What is claimed is:

1. In a laundry dryer having a rotatable drum with a filling orifice issuing into the drum and a door for closing the filling orifice, a drying rack comprising:

at least two air-permeable surfaces holding in a stationary manner within the drum a batch of laundry to be dried with the laundry resting on the at least two air-permeable surfaces, the air-permeable surfaces remaining stationary while the drum rotates with respect to the air-permeable surfaces:

being spaced apart from another at a distance one above another in an operating state thereof; and having a front side defining an access orifice and a side defining at least one further access orifice permitting insertion of the laundry; and fastening devices removably fastening said surfaces to the laundry dryer.

2. The drying rack according to claim 1, wherein said surfaces are releasably connected to said drying rack.

3. The drying rack according to claim 1, wherein said surfaces are releasably connected to said fastening devices.

4. The drying rack according to claim 1, wherein at least one of said surfaces is connected in an articulated manner to another of said surfaces.

5. The drying rack according to claim 1, wherein at least one of said surfaces is pivotably connected to another of said surfaces.

6. The drying rack according to claim 1, further comprising connecting members, said surfaces having corners, said connecting members holding said surfaces at a distance from one another at said corners.

7. The drying rack according to claim 6, wherein said surfaces have a given thickness and said connecting members have a thickness greater than or equal to said given thickness and less than three times said given thickness.

8. The drying rack according to claim 1, wherein said surfaces have an air-permeable fine-mesh and flexible plastic nettings each with a surrounding plastic frame.

9. A laundry dryer, comprising:

a rotatable drum with a filling orifice issuing into said drum, said drum having a front bearing plate with a loading orifice and plate fastening devices;

a door connected to said bearing plate for closing at least one of said filling orifice and said loading orifice; and a drying rack stationarily mounted within the dryer while the drum rotates around the drying rack and having:

at least two air-permeable surfaces holding in a stationary manner within said drum a batch of laundry to be dried with the laundry resting on the at least two air-permeable surfaces, the at least two air-permeable surfaces:

being spaced apart from another at a distance one above another in an operating state thereof, and having a front side defining an access orifice and a side defining at least one further access orifice permitting insertion of the laundry; and rack fastening devices removably fastening said surfaces to said plate fastening devices and matching said plate fastening devices.

10. A laundry dryer, comprising:

a housing;

a rotatable drum with a filling orifice issuing into said drum, said drum:

being rotatably connected to said housing; and having a front bearing plate with a loading orifice and plate fastening devices;

a door connected to said housing for closing at least one of said filling orifice and said loading orifice; and a drying rack stationarily mounted within the dryer while the drum rotates around the drying rack and having:

at least two air-permeable surfaces holding in a stationary manner within said drum a batch of laundry to be dried with the laundry resting on the at least two air-permeable surfaces, the at least two air-permeable surfaces:

being spaced apart from another at a distance one above another in an operating state thereof wherein the at least two air-permeable surfaces include a first surface extending in a substantially horizontal direction and a second surface spaced apart from the first surface and extending in a direction substantially parallel to the first surface; and having a front side defining an access orifice and a side defining at least one further access orifice permitting insertion of the laundry; and rack fastening devices removably fastening said surfaces to said plate fastening devices and corresponding with said plate fastening devices.

11. The laundry dryer according to claim 10, wherein the access orifice and the at least one further access orifice are disposed between the first and second surfaces.

12. The laundry dryer according to claim 10, wherein the at least two air-permeable surfaces includes a third surface spaced apart from both the first and second surfaces and extending in a direction substantially parallel to the first and second surfaces.

13. The laundry dryer according to claim 9, wherein the at least two air-permeable surfaces include a first surface extending in a substantially horizontal direction and a second surface spaced apart from the first surface and extending in a direction substantially parallel to the first surface.

14. The laundry dryer according to claim 13, wherein the at least two air-permeable surfaces includes a third surface spaced apart from both the first and second surfaces and extending in a direction substantially parallel to the first and second surfaces.

15. The laundry dryer according to claim 13, wherein the access orifice and the at least one further access orifice are between disposed between the first and second surfaces.

* * * * *